US009788366B2

(12) United States Patent
Spalding, Jr. et al.

(10) Patent No.: US 9,788,366 B2
(45) Date of Patent: Oct. 10, 2017

(54) APPARATUS FOR CURING COMPOSITE MATERIALS AND METHOD OF USE THEREOF

(71) Applicant: The Boeing Company, Chicago, IL (US)

(72) Inventors: John F. Spalding, Jr., Renton, WA (US); Christopher John Hottes, Seattle, WA (US); Robert James Miller, Fall City, WA (US)

(73) Assignee: The Boeing Company, Chicago, IL (US)

( * ) Notice: Subject to any disclaimer, the term of this patent is extended or adjusted under 35 U.S.C. 154(b) by 127 days.

(21) Appl. No.: 14/512,329

(22) Filed: Oct. 10, 2014

(65) Prior Publication Data

US 2016/0105929 A1 Apr. 14, 2016

(51) Int. Cl.
*H05B 3/06* (2006.01)
*H05B 3/04* (2006.01)
(Continued)

(52) U.S. Cl.
CPC ..... *H05B 3/04* (2013.01); *H05B 3/06* (2013.01); *H05B 3/34* (2013.01); *H01R 13/5219* (2013.01); *H05B 2203/003* (2013.01)

(58) Field of Classification Search
CPC ..... H05B 3/34; B64F 5/0081; B29C 2043/3644; B29C 65/02; B29C 43/12;
(Continued)

(56) References Cited

U.S. PATENT DOCUMENTS 3,622,940 A * 11/1971 Illies ..... H01F 27/40 174/18
3,675,896 A * 7/1972 Mercier ..... F16K 1/34 251/321

(Continued)

OTHER PUBLICATIONS

Conax® Technologies, Multiple Element Sealing, 2013, retrieved from the internet on Oct. 10, 2014 from http://www.conaxtechnologies.com/sg_selection.aspx?section=4, 2 pages.

(Continued)

*Primary Examiner* — Scott W Dodds
(74) *Attorney, Agent, or Firm* — Kolisch Hartwell, P.C.

(57) ABSTRACT

An apparatus may include a curing apparatus and an electrical coupler. The curing apparatus may include one or more electrical components related to curing a composite material inside a vacuum chamber at least partially defined by a flexible wall. The electrical coupler may be connected to the curing apparatus. The coupler may include a first set of one or more electrical contacts electrically connected to the one or more electrical components of the curing apparatus inside the vacuum chamber. The coupler may be configured to hermetically extend through a hole in the flexible wall. Such extension may dispose the first set of one or more electrical contacts in a space outside of the vacuum chamber for electrical interconnection of the one or more electrical components of the curing apparatus inside the vacuum chamber with circuitry disposed in the space outside of the vacuum chamber.

20 Claims, 5 Drawing Sheets

(51) Int. Cl.
*H05B 3/34* (2006.01)
*H01R 13/52* (2006.01)

(58) Field of Classification Search
CPC ..... H01R 13/52; H01R 13/5202; H01R 13/5219; H01R 13/5221
USPC ..... 156/285, 286; 439/271–277, 283, 439/587–589
See application file for complete search history.

(56) References Cited

U.S. PATENT DOCUMENTS 3,875,373 A * 4/1975 Lowery ..... H05B 3/00 219/494
4,352,707 A * 10/1982 Wengler ..... B29C 65/18 156/285
4,666,228 A * 5/1987 Wood ..... H01R 13/746 29/876
4,967,057 A * 10/1990 Bayless ..... H05B 3/36 219/213
6,184,496 B1 * 2/2001 Pearce ..... E01C 11/265 219/202
8,330,086 B2 12/2012 Miller et al.

OTHER PUBLICATIONS

Glenair, AlphaLink PC Board Connectors and Jumpers, 2013, retrieved from the internet on Oct. 10, 2014 from http://www.glenair.com/alphalink/index.htm, 3 pages.
Conax® Technologies, Aerospace Parts Autoclave Assembly Power Feedthrough, 2014, retrieved from the internet on Aug. 5, 2014 from http://www.conaxtechnologies.com/case_Aerospace%20Parts%20Autoclave%20Assembly.aspx, 1 page.
Conax® Technologies, Flanges for Sealing Glands, 2014, retrieved from the internet on Aug. 5, 2014 from http://www.conaxtechnologies.com/sg_flang.aspx, 1 page.
Airtech, Vacuum Connector—Aluminum, retrieved from the internet on Oct. 10, 2014 from http://www.acpsales.com/Vacuum-Connector-Aluminum.html, 1 page.

* cited by examiner

APPARATUS FOR CURING COMPOSITE MATERIALS AND METHOD OF USE THEREOF

FIELD

This disclosure relates to apparatuses and methods associated with curing composite materials. More specifically, the disclosed embodiments relate to systems and methods for electrically interconnecting a composite material curing apparatus disposed inside a vacuum chamber with circuitry disposed outside the vacuum chamber.

INTRODUCTION

Composite materials are typically made from two or more constituent materials with significantly different physical or chemical properties. Typically, the constituent materials include a matrix (or bond) material, such as resin (e.g., thermoset epoxy), and a reinforcement material, such as a plurality of fibers (e.g., a woven layer of carbon fibers). When combined, the constituent materials typically produce a composite material with characteristics different from the individual constituent materials even though the constituent materials generally remain separate and distinct within the finished structure of the composite material. Carbon-fiber-reinforced polymer is an example of such a composite material.

Composite materials may be preferred for many reasons. For example, composite materials may be stronger and/or lighter than traditional materials. As a result, composite materials are generally used to construct various objects such as vehicles (e.g., airplanes, automobiles, boats, bicycles, and/or components thereof), and non-vehicle structures (e.g., buildings, bridges, swimming pool panels, shower stalls, bathtubs, storage tanks, and/or components thereof).

Occasionally, these composite materials may become damaged, in which case it may be preferable to repair the damaged composite material rather than replace it entirely. Such composite repairs are typically performed without the use of an oven or an autoclave to provide heat. In these instances, an alternative heat source, such as a heater mat (e.g., including electrical resistance wires encapsulated in silicon rubber), may be used to raise the temperature of a composite repair material to a cure temperature.

Generally, the heater mat and the composite repair material are compacted toward the damaged composite material through atmospheric pressure applied via a vacuum bag film, which is sealed to the damaged composite material by adhesive tape to form a vacuum chamber. Pre-existing apparatuses and methods involve routing power leads for the heater mat and associated sensor wires out of the vacuum chamber between an interface of the vacuum bag film and the composite material, and sealing the interface with several layers of vacuum sealant tape. However, these pre-existing apparatuses and methods may sometimes create leaks in the vacuum chamber, damage various components during a debagging process, and require significant lay-up time.

SUMMARY

Disclosed herein are various examples of apparatuses and methods, which may decrease vacuum chamber leaks, reduce damage to various components, and/or reduce lay-up times.

In one example, an apparatus may include a curing apparatus and an electrical coupler. The curing apparatus may include one or more electrical components related to curing a composite material inside a vacuum chamber at least partially defined by a flexible wall. The electrical coupler may be connected to the curing apparatus. The coupler may include a first set of one or more electrical contacts electrically connected to the one or more electrical components of the curing apparatus inside the vacuum chamber. The coupler may be configured to hermetically extend through a hole in the flexible wall. Such extension may dispose the first set of one or more electrical contacts in a space outside of the vacuum chamber for electrical interconnection of the one or more electrical components of the curing apparatus inside the vacuum chamber with circuitry disposed in the space outside of the vacuum chamber.

In another example, an apparatus may include a heater mat and an electrical coupler. The heater mat may include one or more electrical components for applying thermal energy to a composite material inside a vacuum chamber. The vacuum chamber may be at least partially defined by a flexible wall. The flexible wall may be configured to apply a pressing force against the composite material via the heater mat when the vacuum chamber is substantially evacuated and as the application of the thermal energy at least partially cures the composite material to a substantially cured state. The electrical coupler may include male and female connector portions. One of the male and female connector portions may be connected to the heater mat. The connector portion that is connected to the heater mat may include a first set of one or more electrical contacts electrically connected to the one or more electrical components of the heater mat. The other of the connector portions may include a second set of one or more electrical contacts configured for electrical connection to circuitry disposed outside of the vacuum chamber. The electrical coupler may be configured to extend through and hermetically seal a hole in the flexible wall, and to electrically interconnect the first and second sets of one or more electrical contacts when the male and female connector portions are mated for electrical interconnection of the one or more electrical components of the heater mat disposed inside the vacuum chamber with the circuitry disposed outside of the vacuum chamber.

In another example, a method may include positioning a curing apparatus on a cure zone of a composite material. The curing apparatus may include one or more electrical components electrically connected to a first set of one or more electrical contacts. The method may further include disposing a vacuum bag film over the curing apparatus opposite the composite material. The method may further include securing the vacuum bag film to the composite material with an adhesive interface to form a vacuum chamber in which the curing apparatus is disposed. The method may further include hermetically extending the first set of one or more electrical contacts through a hole in the vacuum bag film.

The present disclosure provides various apparatuses and methods for hermetically passing electrical connections through an opening (or hole) in a flexible wall of a vacuum chamber. In some embodiments, the first connector portion may be mounted on the curing apparatus (e.g., on a heater mat). In some embodiments, mating the first and second connector portions may both electrically interconnect the respective first and second sets of one or more electrical contacts and may hermetically seal the hole in the flexible wall through which the coupler extends. In some embodiments, an interior of the first connector portion may be hermetically sealed with a potting material from which the first set of one or more electrical contacts may protude.

The features, functions, and advantages may be achieved independently in various embodiments of the present disclosure, or may be combined in yet other embodiments, further details of which can be seen with reference to the following description and drawings.

DESCRIPTION

Overview

Figure 1:
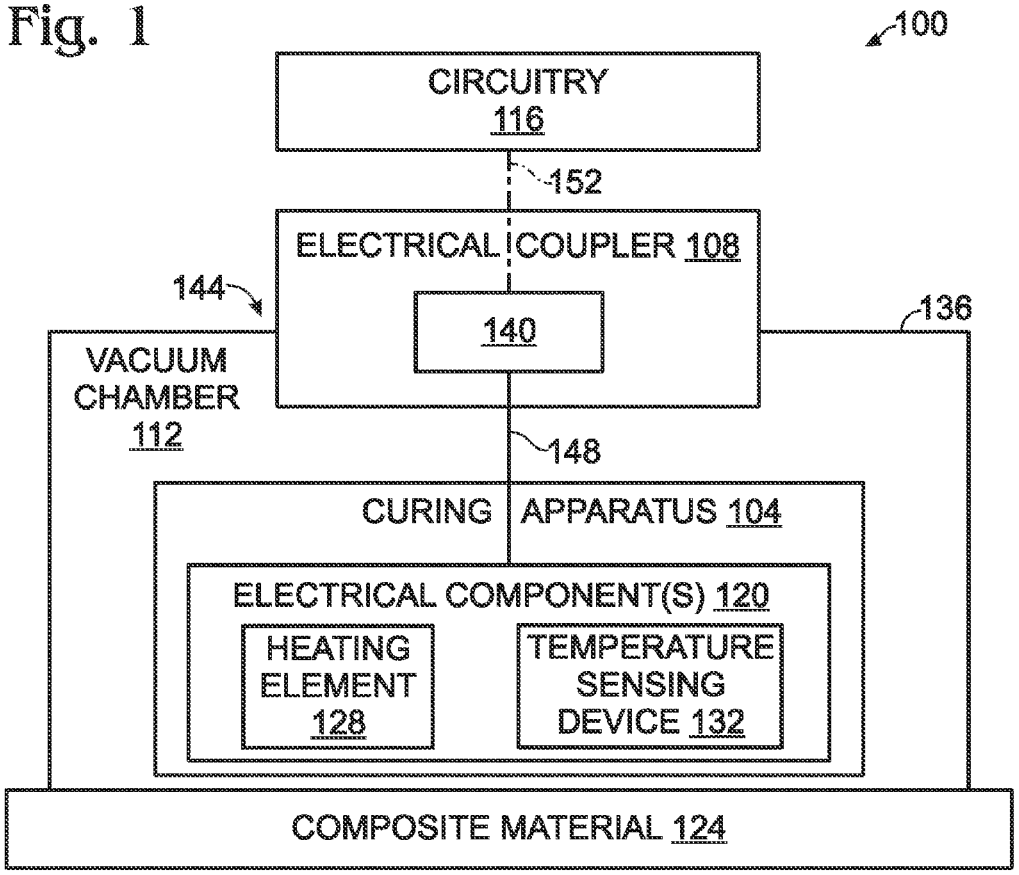
FIG. 1 is general block diagram schematically illustrating a system including an electrical coupler configured for electrically interconnecting a curing apparatus disposed inside a vacuum chamber with circuitry disposed outside the vacuum chamber.

Various embodiments of systems, apparatuses, and methods are described below and illustrated in the associated drawings. Unless otherwise specified, systems, apparatuses, and/or methods and/or their various components and/or steps may, but are not required to, contain at least one of the structure, components, functionality, and/or variations described, illustrated, and/or incorporated herein. Furthermore, the structures, components, functionalities, and/or variations described, illustrated, and/or incorporated herein in connection with the present teachings may, but are not required to, be included in other similar systems, apparatuses, and/or methods. The following description of various embodiments is merely exemplary in nature and is in no way intended to limit the disclosure, its application, or uses. Additionally, the advantages provided by the embodiments, as described below, are illustrative in nature and not all embodiments provide the same advantages or the same degree of advantages.

Generally, success of a composite repair is related to the vacuum chamber formed by the vacuum bag being substantially leak free. In particular, if the vacuum chamber has significant leaks, then the vacuum bag may not apply a sufficient compacting or pressing force on a composite material patch toward a repair area of an existing composite material (or other suitable bond interface). For example, a large portion of composite repair processes require that the vacuum chamber formed by the vacuum bag be leak tested prior to starting a cure cycle. Typically, the maximum allowable leak rate is 5 inches of mercury (5 inHg, or 127 mmHg) in a five minute interval. Further, some repair processes are more restrictive and only allow a leak rate of 2 inHg (or 51 mmHg).

Pre-existing methods of connecting a heater mat (or heat blanket) to a power supply involve routing power leads of the heater mat out of the vacuum chamber through an interface of the vacuum bag and the composite material, and applying several layers of vacuum sealant tape to the power leads at the interface in an attempt to seal the vacuum chamber, as described above. However, these pre-existing methods typically pose various problems, such as vacuum leaks, poor durability, and complicated lay-ups or configurations resulting in significant bagging and debagging process times, as mentioned above and described below in more detail.

In particular, space between a power lead insulating sleeve and conductor wire (e.g., disposed in the insulating sleeve) typically creates a leak path for air to enter the vacuum chamber in pre-existing methods and apparatuses. For example, air typically enters the insulating sleeve at a termination of the insulating sleeve associated with a plug making the connection to the power supply. This air then travels inside the insulating sleeve into the vacuum chamber. Thus, it is not unusual for pre-existing new and unused heat blankets to cause vacuum leaks in excess of 127 mmHg in five minutes through their power leads. Such a high leak rate typically renders a heat blanket unsuitable for performing a composite repair inside a vacuum chamber with pre-existing methods.

Further, power leads of pre-existing heat blankets are often damaged or cut during debagging operations (or processes) associated with pre-existing apparatuses and methods. For example, the vacuum sealant tape used to "seal" the interface between the vacuum bag, power leads, and composite material is typically extremely sticky and strong, and extracting the heat blanket power leads from such tape often requires significant pulling, tugging, and cutting. Such pulling, tugging, and/or cutting often causes breakage of the conductor wire of the power lead, damage to the insulating sleeve of the power lead, and/or increased vacuum leaks (e.g., as such damage to the power leads may increase air flow into the vacuum chamber if used in a subsequent repair process).

Moreover, as heat blanket technology becomes more sophisticated, the number of wires for powering and controlling the blanket often increases. For example, a multi-zone heat blanket and control system may include an array of 32 heat zones incorporated into a single blanket, with each individual zone having two power leads and an associated control thermocouple. Such a system may include a total of 96 or more wires to be routed under the vacuum bag and through the vacuum sealant tape, making for complicated and time consuming bagging and debagging operations.

However, embodiments of the present disclosure may overcome and/or avoid one or more of the problems described above. For example, embodiments disclosed herein may connect electrical components (e.g., heating elements and/or sensing elements) of or associated with a heater mat to circuitry (e.g., a power supply and/or control equipment) outside of the vacuum chamber in a robust, time efficient, and/or leak free manner. In one embodiment, an electrical coupler including an inner connector and an outer connector may be incorporated into (or at least partially intergral with) a heater mat. For example, the inner connector may be intergral with (e.g., mounted on) the heater mat. Electrical contacts may be disposed in an interior of the inner connector and electrically connected to one or more of the electrical components of the heater mat. The inner connector may exit the vacuum chamber through an aperture (or opening, or hole) in the vacuum bag. A rubber gasket (or washer, or other suitably resilient member), and a rigid compression washer (or other suitably rigid member) may be serially placed over (e.g., around) the inner connector that protrudes through the aperture in the vacuum bag. The outer connector, which may include electrical contacts configured for electrical connection to the circuitry, may be threaded onto (or otherwise coupled to) the inner connector and tightened. Tightening the outer connector onto the inner connector may provide a reliable and robust vacuum tight seal by sandwiching the vacuum bag between the compressed rubber washer and a base flange of the inner connector. Further, such mating of the inner and outer connectors may electrically interconnect the electrical contacts of the inner connector with the corresponding electrical contacts of the outer connector for operation and/or monitoring of the electrical components of the heater mat disposed inside the vacuum chamber by the circuitry disposed outside of the vacuum chamber. Moreover, the interior of the inner connector may be sealed with a potting compound, or other suitable material (or apparatus, device, structure, and/or mechanism) for preventing a vacuum leak via the interior of the inner connector.

Such a configuration may significantly reduce vacuum leaks, particularly as compared to pre-existing configurations and methods. Further, a durability of such a configuration may be significantly improved as compared to pre-existing configurations. In particular, in such a configuration, removing the heater mat from the vacuum bag (e.g., in a debagging process) may merely involve unscrewing the outer connector from the inner connector and decoupling the respective electrical contacts from one another. Moreover, a convenience (or efficiency) of connecting such a configuration (e.g., in a bagging process) may be improved. For example, since the electrical coupler may be integrated into the heater mat, may include multiple electrical contacts for multiple electrical components inside the vacuum chamber, and may be configured to hermetically extend through and seal a hole in the vacuum bag, routing a plurality of wires under the vacuum bag and through the interface of the vacuum bag and the composite material with sealant tape may be avoided.

EXAMPLES, COMPONENTS, AND ALTERNATIVES

The following examples describe selected aspects of exemplary apparatuses as well as related systems and/or methods. These examples are intended for illustration and should not be interpreted as limiting the entire scope of the present disclosure. Each example may include one or more distinct inventions, and/or contextual or related information, function, and/or structure.

Example 1

This example describes an illustrative system 100 including a curing apparatus 104, an electrical coupler 108, a vacuum (or air-tight) chamber 112, and circuitry 116; see FIG. 1.

In this example, curing apparatus 104 may include one or more electrical components 120. Electrical components 120 may be related to curing a composite material 124 inside vacuum chamber 112. For example, electrical components 120 may include a heating element (or device) 128 and a temperature sensing device (or sensing element) 132. Heating element 128 may be included in a heater mat. Temperature sensing device 132 may include a thermocouple (or other suitable device for sensing and/or measuring a temperature, such as an infrared camera), which may or may not be included in the heater mat.

Vacuum chamber 112 may be at least partially defined by a flexible wall 136. For example, wall 136 may be a vacuum bag made of a suitable polymer film (or other suitable material), that may be secured to composite material 124 to form chamber 112. However, in other examples, composite material 124 may be completely disposed in chamber 112, for example, when system 100 is used to manufacture composite material 124. For example, wall 136 may completely surround composite material 124. In either case, wall 136 may be configured to apply pressure to composite material 124 when chamber 112 is evacuated. Such pressure may be configured to compact at least a portion of composite material 124 (e.g., a composite material patch applied to a rework area of composite material 124) as curing apparatus 104 applies thermal energy to a bond interface of composite material 124 associated with that compacted portion of composite material 124. Application of the thermal energy may be configured to perform a cure cycle, such as an exemplary cure cycle depicted in FIG. 5, which may cure the bond interface to a substantially cured state thereby securing the compacted portion of composite material 124 in position.

Figure 2:
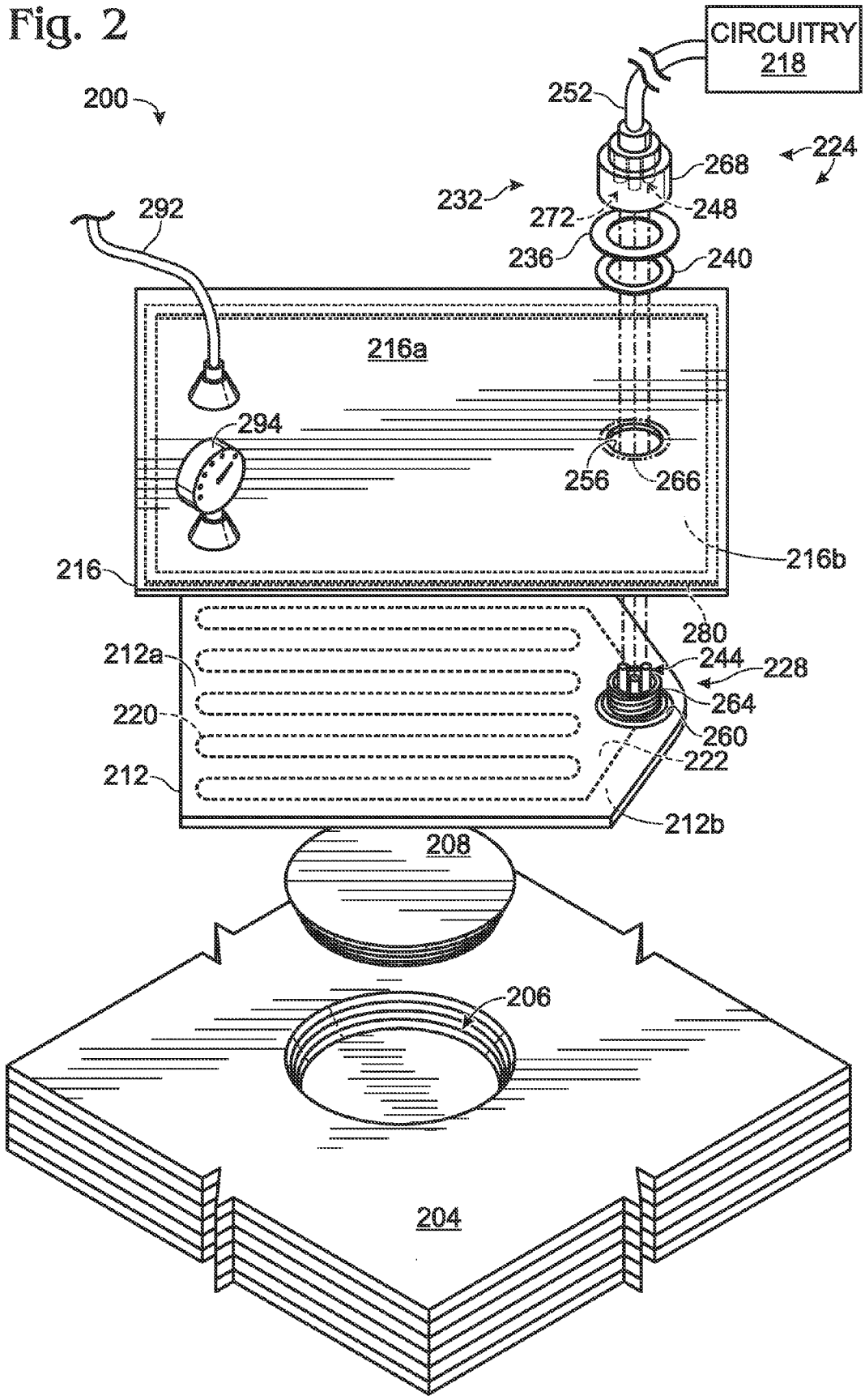
FIG. 2 is a semi-schematic partially exploded perspective view of a system including a composite material surface including a rework area, a composite material patch, a flexible vacuum bag film, an adhesive interface, circuitry, and an embodiment of the electrical coupler and curing apparatus of FIG. 1, with the electrical coupler shown here as including mateable first and second connector portions, and the curing apparatus as including a heater mat to which the first connector portion is mounted.
Figure 3:
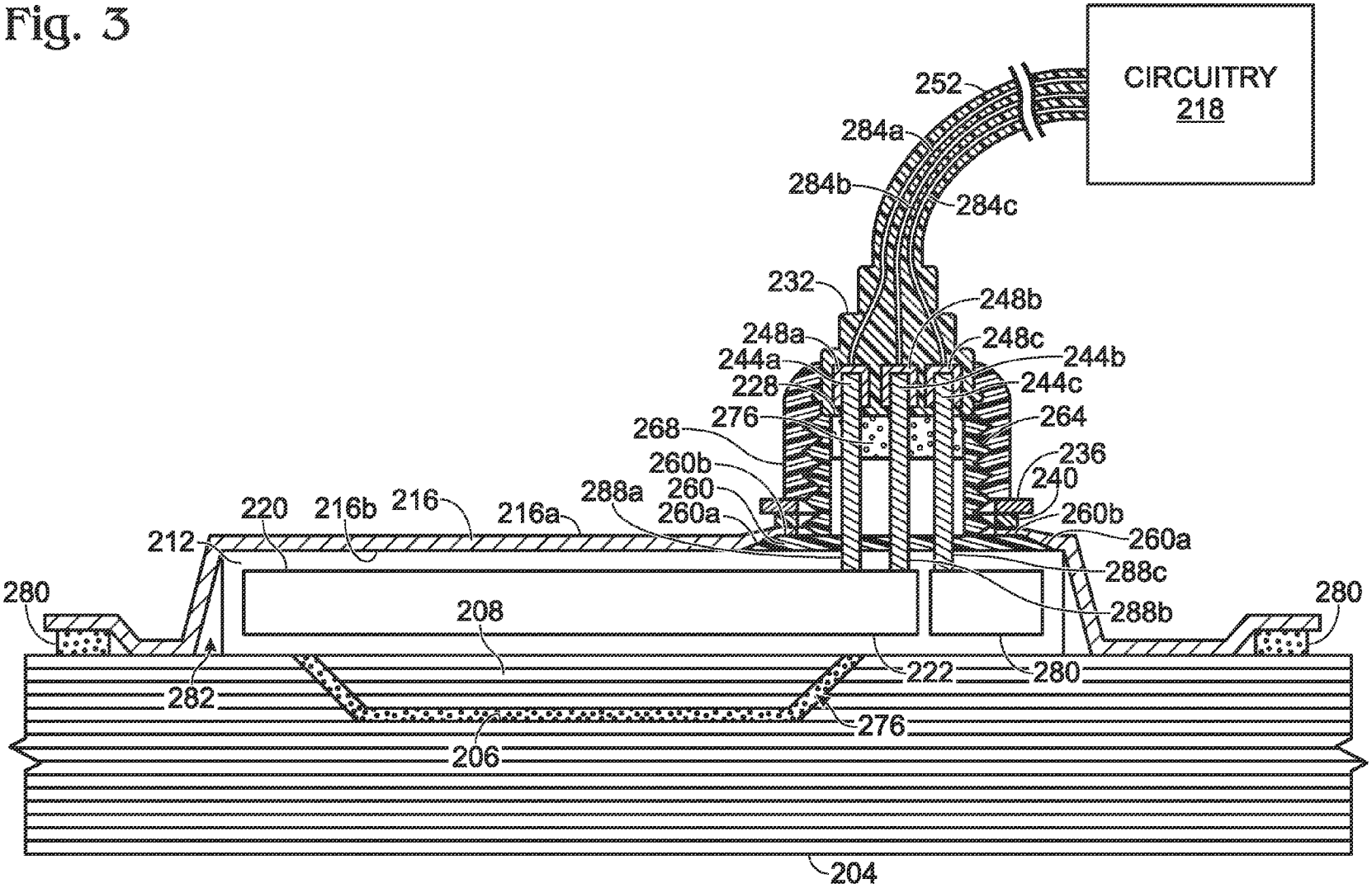
FIG. 3 is semi-schematic partial cross-sectional view of a lay-up of the system of FIG. 2 including the film secured to the composite material surface by the adhesive interface to form a vacuum chamber in which the heater mat is disposed, the first and second connector portions in a mated position to electrically interconnect respective first and second sets of one or more electrical contacts and to seal a hole in the vacuum bag film through which the electrical coupler extends, and the vacuum chamber evacuated so that the film applies a pressing force against the composite material and the patch via the heater mat.

Curing apparatus 104 and electrical coupler 108 may be included in an apparatus, which may decrease vacuum leaks in chamber 112, reduce possible damage to components of system 100, and/or reduce a lay-up time of system 100, as mentioned above, and as will be described below in further detail. For example, electrical coupler 108 may be connected to curing apparatus 104. Coupler 108 may include a first set of one or more electrical contacts 140. Contacts 140 may be electrically connected to electrical components 120 inside vacuum chamber 112. For example, one or more conductors 148 may electrically connect electrical contacts 140 with associated electrical components 120. Coupler 108 may be configured to hermetically extend through a hole 144 in flexible wall 136. Such extension of coupler 108 may dispose electrical contacts 140 (e.g., at least a portion thereof) in a space outside of vacuum chamber 112, a particular example of which is depicted in FIGS. 2 and 3 and described below in more detail.

For example, coupler 108 may be configured to extend through hole 144 in a substantially air-tight manner by hermetically clamping a region of flexible wall 136 surrounding an entire perimeter of hole 144. For example, the hermetic clamping may be performed by an exterior portion of coupler 108. An interior of coupler 108, in which contacts 140 may be at least partially disposed, may be hermetically sealed with a suitable structure, device, apparatus, mechanism, material, or combination thereof for preventing air from infiltrating vacuum chamber 112 from the space outside of vacuum chamber 112 via the interior of coupler 108. For example, the interior of coupler 108 may be sealed by a substantially non-pourous potting compound from which electrical contacts 140 may protrude.

Electrical contacts 140 disposed in the space outside of vacuum chamber 112 may permit electrical interconnection of electrical components 120 with circuitry 116. For example, coupler 108 may include one or more conductors 152 (e.g., a second set of corresponding electrical contacts that mate with contacts 140) configured to electrically connect (or interconnect) electrical contacts 140 with circuitry 116.

Heating element 128 may be configured to be powered by circuitry 116 (e.g., receive electrical current from circuitry 116) via contacts 140 for applying thermal energy to composite material 124 to cure the composite material (e.g., a bond interface thereof) to the substantially cured state. For example, heating element 128 may include an electrically resistive component configured to convert received electrical current from circuitry 116 into the thermal energy, and direct that thermal energy to composite material 124.

Temperature sensing device 132 may be configured to measure a temperature of composite material 124 (e.g., proximate the bond interface and/or heating element 128). Device 132 may further be configured to transmit a signal indicative of the measured temperature of composite material 124 to circuitry 116 via electrical contacts 140. Circuitry 116 may be configured to control power to heating element 128 based at least in part on the signal received from temperature sensing device 132. For example, if the signal indicates that the temperature of composite material 124 is higher than a preferred temperature for an associated segment (or phase) of the cure cycle, then circuitry 116 may reduce power to heating element 128. However, if the signal indicates that the temperature of composite material 124 is lower than a preferred temperature of the associated segment of the cure cycle, then circuitry 116 may increase power to heating element 128.

Example 2

This example describes an illustrative system 200, which is an embodiment of system 100; see FIGS. 2 and 3.

System 200 may include any apparatus, device, mechanism, structure, material, and/or combination thereof for suitably curing a composite material 204 (e.g., a bond interface between a rework area 206 of composite material 204 and a composite material patch 208) inside a vacuum chamber, an exemplary formation (or lay-up) of which is shown in FIG. 3 and described further below in more detail.

For example, system 200 may include a curing apparatus (or heater mat) 212, a flexible vacuum bag (or vacuum bag film, or flexible wall) 216, and circuitry 218. Curing apparatus 212 may include one or more electrical components, such as one or more heating elements 220 electrically connected to a bus bar 222, for applying thermal energy to composite material 204 inside the vacuum chamber.

System 200 may further include an electrical coupler 224. Coupler 224 may include mateable first and second connector portions 228, 232, and first and second washers (or gaskets) 236, 240. As shown, first connector portion 228 may be connected to (e.g., mounted to and/or on) heater mat 212. First connector portion 228 may include a first set of one or more electrical contacts 244 (e.g., shown here as including three protruding male electrical contacts or pins, which may be solid). Electrical contacts 244 may be electrically connected to the electrical components of heater mat 212. For example, electrical contacts 244 may be electrically connected to heating elements 220 via electrical connection to bus bar 222. In some embodiments, at least one of electrical contacts 244 may be associated with a positive voltage power lead of heater mat 212, at least one of electrical contacts 224 may be associated with a negative voltage power lead of heater mat 212, and one of electrical contacts 224 may be associated with a circuit ground associated with heater mat 212. Alternatively and/or additionally, one or more of electrical contacts 244 may be associated with a sensor element, which may be included in, or used in conjunction with, heater mat 212.

Second connector portion 232 may include a second set of corresponding one or more electrical contacts 248 (e.g., shown here as including three female receptacle electrical contacts). Electrical contacts 248 may be configured for electrical connection to circuitry 218, for example, via one or more electrically conductive cables 252.

Electrical coupler 224 may include any suitable apparatus, device, mechanism, structure, material, and/or combination thereof configured for hermetic extension of coupler 224 through a hole 256 in film 216 and to electrically interconnect electrical contacts 244 with corresponding electrical contacts 248 when first and second connector portions 228, 232 are mated. Such mating may electrically interconnect the one or more electrical components of curing apparatus 212 with circuitry 218 for operation of curing apparatus 212 in conjunction with circuitry 218 for curing the bond interface of composite material 204.

For example, first connector portion 228 may be mounted on (or to) a first major face 212*a* of heater mat 212. As shown, first connector portion 228 is a male connector portion including a base flange 260, and a barrel 264, one or more of which may be mounted to major face 212*a* of heater mat 212. Base flange 260 may extend generally parallel to major face 212*a*. Barrel 264 may project away from major face 212*a* and base flange 260. Base flange 260 may radially surround, extend from, and/or be connected to a lower portion of barrel 264. An upper portion of barrel 264 may be configured to be received through hole 256 such that a region 266 of film 216 surrounding an entire perimeter of hole 256 contacts base flange 260 opposite major face 212*a*.

Second connector portion 232 may be a female connector portion. For example, second connector portion 232 may include an outer sidewall 268, which may define an inner recess 272 for receiving (e.g., mating with) barrel 264.

Coupler 224 may be configured to clamp region 266 between second connector portion 232 and base flange 260 when connector portions 228, 232 are mated (e.g., when barrel 264 is received in recess 272). Such clamping may form a hermetic (e.g., substantially air-tight) seal between base flange 260 and region 266.

More specifically, in an exemplary lay-up (e.g., bagging process) of system 200, rework area 206 may be identified. Rework area 206 may correspond to a damaged area of composite material 204, and/or an area of composite material 204 in which it is desired to add a new composite material feature. In either case, rework area 206 may be prepared by tapering edges of rework area 206, and/or cleaning a surface of rework area 206. Patch 208 may be positioned in (or proximate) rework area 206 with a bond interface 276 (see FIG. 3), which may include a layer of adhesive (e.g., resin matrix material) sandwiched between two layers of permeable positioning fabric (e.g., reinforcement material), a suitable example of which is described and shown in U.S. patent application Ser. No. 14/276,918, which is hereby incorporated by reference in its entirety for all purposes. It should be noted that bond interface 276 is not shown in FIG. 2 to simplify the illustration, but that when system 200 is layed-up, for example as shown in FIG. 3, bond interface 276 may be disposed between patch 208 and rework area 206.

Curing apparatus 212 may be positioned on a cure zone of (e.g., associated with) composite material 204. For example, the cure zone may be associated with bond interface 276 between patch 208 and rework area 206. In some embodiments, the cure zone may alternatively and/or additionally be associated with patch 208, for example, if patch 208 includes uncured composite material components, such as a one or more layers of pre-preg. For example, positioning curing apparatus 212 on the cure zone may involve disposing curing apparatus 212 proximate patch 208 and bond interface 276 adjacent rework area 206.

Though not shown for simplicity of illustration, positioning curing apparatus 212 on the cure zone may involve positioning one or more of a perforated release film, a bleeder layer, an unperforated release film, and a breather layer serially upon the cure zone between patch 208 and curing apparatus 212. The perforated release film may be a thin non-bondable film with relatively small perforations at regular spacings to allow air and excess resin extraction from the bond interface. The perforated release film may be configured to prevent the remaining bagging materials (e.g., the bleeder layer, the unperforated release film, the breather layer, curing apparatus 212, and film 216) from becoming bonded to composite material 204 during a cure cycle while still allowing air and excess resin extraction. The bleeder may be a thin fabric layer that may be placed over the perforated release film to provide an air evacuation path and absorb excess resin. The unperforated release film may be made of the same material as the perforated release film, but not perforated. The unperforated release film may be configured to prevent excess resin from flowing to other bagging components, such as the bleeder layer, curing apparatus 212, and film 216. The breather layer may include a relatively heavy fabric material or non-woven material for providing an air path for air extraction from inside the vacuum chamber and provide insulation.

A major face 212*b* of curing apparatus 212 opposite major face 212*a* may be positioned on the bleeder layer opposite patch 208, bond interface 276, and rework area 206. Film 216 may be disposed over curing apparatus 212 opposite composite material 204. Film 216 may be secured (e.g., sealed) to composite material 204 with an adhesive interface 280 (e.g., double-sided vacuum sealant tape) to form the vacuum chamber, generally indicated at 282 in FIG. 3. Adhesive interface 280 may be disposed on a second major face (or surface) 216*b* of film 216, which may be opposite first major face 216*a*. As shown, curing apparatus 212 may be disposed in formed vacuum chamber 282.

Returning to FIG. 2, hole 256 may be formed (e.g., cut) in film 216 before, after, and/or while film 216 is disposed on curing apparatus 212 opposite composite material 204. For example, in some embodiments, film 216 may be provided from the manufacturer with hole 256 precut, and in other embodiments, hole 256 may be formed after film 216 is secured to composite material 204. As shown, hole 256 may have a slightly larger diameter than barrel 264, which may allow barrel 264 to extend through hole 256 out of vacuum chamber 282.

In an exemplary process of sealing hole 256 with electrical coupler 224, washer 240 may be disposed on barrel 264 protruding through hole 256, such that washer 240 surrounds barrel 264 and contacts region 266 on first major face 216*a* of film 216 facing away from composite material 204, as can be seen in FIG. 3. Washer 236 may be similarly disposed around barrel 264, but contacting washer 240 opposite film 216 instead of region 266. Second connector portion 232 may be tightened (e.g., threaded) onto barrel 264 to draw connector portions 228, 232 toward one another thereby creating a hermetic (e.g., air tight, and/or vacuum tight) seal between region 266 and base flange 260. For example, outer sidewall 268 may include a threaded interior surface corresponding with a threaded exterior surface of barrel 264. Outer sidewall 268 may be configured to rotate relative to electrical contacts 248. Tightening second connector portion 232 onto first connector portion 228 may involve inserting barrel 264 into inner recess 272, and rotating outer sidewall 268 relative to electrical contacts 248 to thread outer sidewall 268 onto barrel 264 thereby drawing connector portions 228, 232 toward one another. As second connector portion 232 is drawn toward first connector portion 228, an opening of inner recess 272 (e.g., which may be formed by a lower portion of outer sidewall 268) may apply a pressing force against washer 240 via washer 236. The pressing force may press washer 240 against first major face 216*a* of film 216 in region 266 to form the hermetic seal between base flange 260 and second major face 216*b* of film 216 in region 266. For example, washer 240 may be made of substantially resilient and/or compliant material, such as rubber, for providing a compliant interface and pressure seal by conformingly pressing against region 266 opposite flange 260. Further, washer 236 may be made of a substantially rigid material, such as a suitable metal, for providing generally uniform application of pressure across washer 240 transmitted from outer sidewall 268.

Such heremetic clamping of region 266 between connector portions 228, 232, in conjunction with a hermetic sealing of an interior of barrel 264, as will be described below in further detail, may permit the hermetic extension of electrical contacts 244 through hole 256 and out of vacuum chamber 282. Thus, time consuming and vacuum leak prone electrical interconnection of pre-existing system and methods that involve routing electrical power leads and sensor wires out of the vacuum chamber proximate the adhesive interface between the vacuum bag film and the composite material may be avoided.

Further, as shown in FIG. 3, the mating of connector portions 228, 232 may be configured to electrically interconnect electrical contacts 244 with electrical contacts 248, for example, by electrical contacts 244 being received in and brought into physical and/or electrical contact with corresponding electrical contacts 248. For example, the first set of electrical contacts 244 may extend through an interior of barrel 264 and away from heater mat 212. The interior of barrel 264 surrounding electrical contacts 244 may be hermetically sealed with a substantially non-porous potting material (or compound) 276. Potting material 276 may be electrically insulating and/or may have a lower thermal conductivity than a material of contacts 248, which may correspondingly prevent short circuiting of the contacts and/or cracking of the hermetic seal formed by the potting material. For example, contacts 248 may be made of copper, or other material with a relatively high thermal conductivity, and potting material 276 may be made from an epoxy resin or material with a suitably low thermal conductivity.

At least a portion of one or more of electrical contacts 244 may protrude from potting material 276 opposite heater mat 212. For example, first ends 244*a*, 244*b*, 244*c* of respective first, second, and third electrical contacts of electrical contacts 244 may extend out of potting material 276. Female receptacle electrical contacts 248*a*, 248*b*, 248*c* of electrical contacts 248 may be configured to receive and electrically connect to respective first ends 244*a*, 244*b*, 244*c* when connector portions 228, 232 are mated, as shown.

As described above, the mating of contacts 244, 248 may electrically interconnect circuitry 218 with the one or more electrical components of (or associated with) heater mat 212, such as heating elements 220 and/or a sensing element 280. For example, contacts 248*a*, 248*b*, 248*c* may be configured for electrical connection to circuitry 218 via respective electrical conductors 284*a*, 284*b*, 284*c*, which may be electrically insulated from one another inside cable 252. Further, first ends 244*a*, 244*b* may be electrically connected to bus bar 222 (and/or heating element 220) via respective electrical conductors 288*a*, 288*b*, and first end 244*c* may be electrically connected to sensing element 280 via electrical conductor 288*c*. In some embodiments, electrical conductors 288*a*, 288*b*, 288*c* may include (or be) second ends of contacts 244 corresponding respectively with first ends 244*a*, 244*b*, 244*c*.

In some embodiments, as shown in FIG. 3, securing film 216 to composite material 204 (with adhesive interface 280), and hermetically sealing the hole in film 216 via the mating action of connector portions 228, 232 may form vacuum chamber 282. Vacuum chamber 282 may be at least partially defined by film 216. Heater mat 212 may be disposed in vacuum chamber 282, for example between film 216 and composite material 204.

In operation, vacuum chamber 282 may be substantially evacuated to a substantially evacuated state, for example, via a vacuum port assembly 292 coupled to film 216 as depicted in FIG. 2, but not shown in FIG. 3 to simplify illustration. Film 216 may be configured to apply a pressing force (e.g., of about 1 atmosphere, which at sea level may be equivalent to 14.7 pounds per square inch or 101,353.0 Newtons per square meter) against composite material 204 (e.g., to compact patch 208 and bond interface 276 onto rework area 206) via heater mat 212 when vacuum chamber 282 is substantially evacuated, and as application of thermal energy from heating elements 220 at least partially cures composite material 204 (e.g., bond interface 276 associated with composite material 204 and patch 208) to a substantially cured state. For example, heating elements 220 may be configured to receive electrical power from circuitry 218 via electrical interconnection of first ends 244*a*, 244*b* with respective contacts 248*a*, 248*b*. Heating elements 220 may be configured to convert the received electrical power into thermal energy. Heating elements 220 may be configured to apply that thermal energy to bond interface 276. For example, heater mat 212 may include one or more components and/or functionalities described in one or more of U.S. Pat. No. 8,330,086 and U.S. patent application Ser. No. 14/253,256, both of which are hereby incorporated by reference in their entireties for all purposes.

Circuitry 218 may be configured to control the application of thermal energy from heating elements 220 to composite material 204, such that composite material 204 (e.g., associated bond interface 276) is suitably cured to the substantially cured state. For example, the exemplary cure cycle depicted in FIG. 5 (or another suitable cure cycle), may be input and/or stored in circuitry 218. Sensing element 280 may be configured to continuously and/or intermittently measure the temperature of the cure zone (e.g., composite material 204, bond interface 276, and/or patch 208). Sensing element 280 may be configured to transmit one or more signals indicative of the measured temperature (or temperatures) to circuitry 218 via electrical interconnection of end 244*c* with contact 248*c*. Circuitry 218 may be configured to receive the one or more signals. Based at least in part on the received one or more signals, circuitry 218 may be configured to adjust and/or maintain the transmission of electrical power to heating elements 220. For example, if the one or more received signals indicate that the temperature of composite material 204 (e.g., associated bond interface 276) is higher than a preferred temperature for an associated segment (or phase) of the cure cycle, then circuitry 218 may reduce power to heating elements 220. However, if the one or more received signals indicate that the temperature of composite material 204 is lower than a preferred temperature of the associated segment of the cure cycle, then circuitry 218 may increase power to heating element 220. While sensing element 280 is schematically depicted in FIG. 3, it should be noted that in various embodiments, sensing element 280 may be indexed with one or more of heating elements 220, and in some embodiments may include a plurality of sensing elements indexed to an array of heating elements. Further, in some embodiments, the sensing element(s) may be powered by circuitry 218 via electrical interconnection of electrical contacts 244, 248.

Various embodiments may be configured to maintain vacuum chamber 282 in the substantially evacuated state such that the atmospheric pressure inside vacuum chamber 282 increases by no more than 127 mmHg in a five minute interval via one or more of adhesive interface 280 and hole 256. In some embodiments, such as those with more restricted parameters, the system may be configured to maintain vacuum chamber 282 in the substantially evacuated state such that the atmospheric pressure inside vacuum chamber 282 increases by no more than 51 mmHg in a five minute interval via one or more of adhesive interface 280 and hole 256. For example, before and/or during application of thermal energy to composite material 204, vacuum chamber 282 may be leak tested. For example, a pressure gauge 294 (see FIG. 2—not shown in FIG. 3 to simplify illustration) may be coupled to film 216 and configured to measure the atmospheric pressure inside vacuum chamber 282. Such maintenance of vacuum chamber 282 in the substantially evacuated state (e.g., as measured by gauge 294) may be permitted by the secure hermetic seal formed by the clamping of region 266 by internally hermetically sealed electric coupler 224 and/or by the avoidance of routing electrical leads for curing apparatus 212 out of the vacuum chamber through an interface of the vacuum bag film and the composite material.

Additional features of system 200 may further increase a durability and/or efficiency of system 200. For example, one or more features of coupler 224 may be configured to prevent damage to film 216 proximal hole 256. For example, base flange 260 may include a tapered outer perimeter (or region) 260*a* that slopes away from a central substantially flat region 260*b* of base flange 260, as can be seen in FIG. 3. Surface 216*b* in region 266 (see FIG. 2) may contact flat region 260*b*. Tapered outer perimeter 260*a* may be configured to allow film 216 proximal region 266 to slope away from rigid washer 236 (as shown in FIG. 3), which may prevent rigid washer 236 from contacting and/or puncturing film 216, if for example, connector 232 is "over-tightened" on barrel 264. Further, upper and/or lower surfaces of respective flat region 260*b* and/or tapered outer perimeter 260*a* may be covered in silicon rubber (or other suitably compliant and/or resilient material), which may improve hermetic sealing of film 216 to base flange 260, and/or decrease abrasion of film 216 by base flange 260. Moreover, potting material 276 may be disposed outside an active heating zone associated with heating elements 220, which may further prevent the interior hermetic seal formed by potting material 276 from cracking or may otherwise limit degradation of the interior seal of connector portion 228 over time.

In some embodiments, one or more components of coupler 224, such as base flange 260, barrel 264, and/or outer sidewall 268 may be made of a material with a relatively low thermal conductivity (e.g., nylon 6-6), which may prevent these components from acting as heat sinks. Such a construction may significantly prevent thermal energy from being drawn away from heating elements 220 and composite material 204 by these components of coupler 224, thereby increasing an efficiency of curing apparatus 212 and/or reducing thermal expansion of these components of coupler 224. Such a reduction of thermal expansion, particularly that associated with barrel 264 and potting material 276, may extend an operational life of coupler 224, as the expansion (and contraction) of these materials may increase a likelihood that the interior hermetic seal formed by potting material 276 may become damaged over time.

Although one embodiment of system 200 is shown in FIGS. 2 and 3, it should be noted that components thereof may be configured in various alternative ways. For example, though contacts 244 are shown protruding out of the upper portion of barrel 264 in which potting material 276 is disposed, in other embodiments, contacts 244 may protrude from potting material 276 inside of barrel 264 and may not extend out of the upper portion of barrel 264. Such a configuration may further prevent film 216 from being torn or otherwise damaged by contacts 244 during the bagging process. Further, while potting material 276 is shown as extending through a minority of a height of barrel 264, in other embodiments, the potting material may extend through a majority of the height of barrel 264, which may increase the hermetic sealing of the interior of barrel 264. Moreover, while connector portion 228 connected to curing apparatus 212 is shown to be a male connector portion, in other embodiments connector portion 228 may be a female connector portion and connector portion 232 may be a male connector portion configured to extend through hole 256 and be received in connector portion 228. In some embodiments, contacts 244 may include female receptacles protruding from (or recessed into) potting material 276, and contacts 248 may include male contacts configured to be received therein. In other embodiments, contacts 244, 248 may be electrically connected but not mate with each other when connector portions 228, 232 are mated. In some embodiments, an interior of connector portion 232 may be hermetically sealed with a suitable potting material in addition to, or instead of, the interior of connector portion 228 being hermetically sealed with potting material 276. Further, while female receptacle contacts 248*a*, 248*b*, 248*c* are shown in FIG. 3 as including distal upper walls that are contacted by respective ends 244*a*, 244*b*, 244*c* when connector portions 228, 232 are mated, in some embodiments these female receptacle contacts may be elongated and/or not include upper walls, which may permit hermetic sealing of vacuum bag films having varying thicknesses and still allow for sufficient electrical interconnection of the respective electrical contacts.

Example 3

Figure 4:
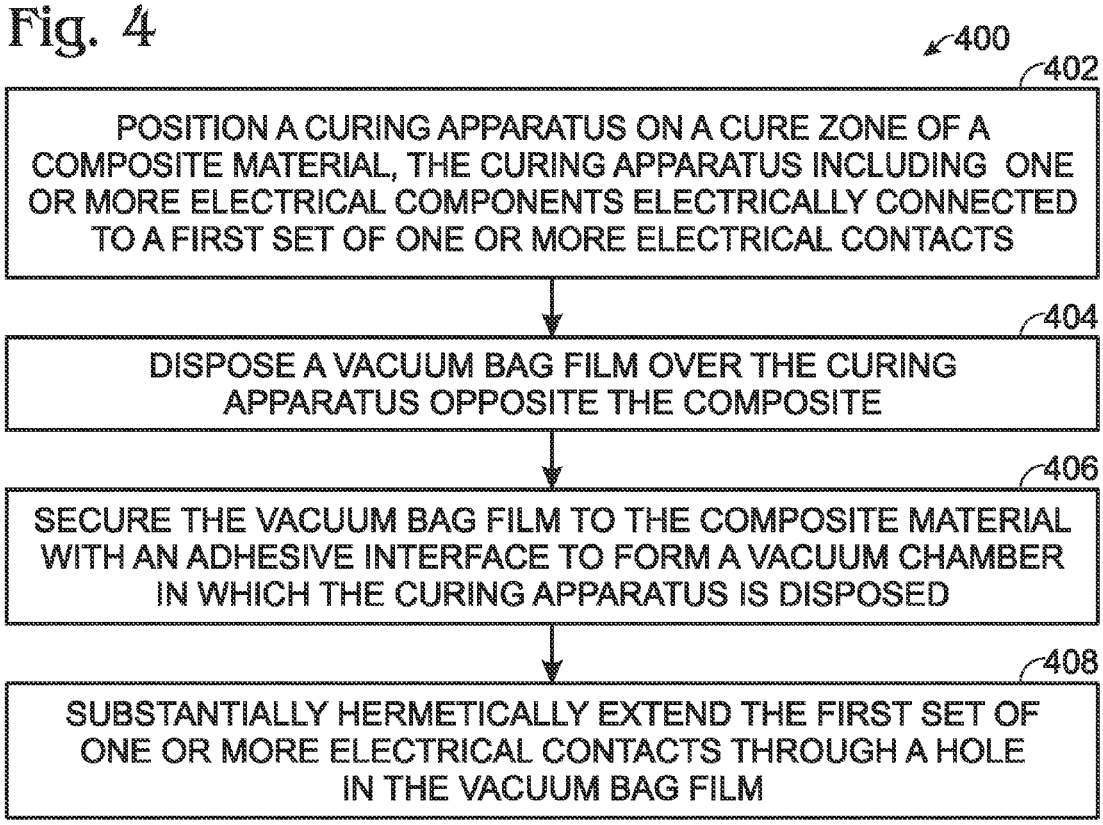
FIG. 4 is a flowchart depicting a method.

This example describes a method; see FIG. 4.

FIG. 4 is a flowchart illustrating steps in an illustrative method, and may not recite the complete process. FIG. 4 depicts multiple steps of a method, generally indicated at 400, which may be performed in conjunction with a curing apparatus and an electrical coupler, such as either of curing apparatuses 104, 212 and couplers 108, 224, according to aspects of the present disclosure. Although various steps of method 400 are described below and depicted in FIG. 400, the steps need not necessarily all be performed, and in some cases may be performed in a different order than the order shown.

As shown, method 400 may include a step 402 of positioning a curing apparatus on a cure zone of a composite material. The curing apparatus may include one or more electrical components electrically connected to a first set of one or more electrical contacts. In some embodiments, the first set of one or more electrical contacts may be included in a first connector portion of a coupler. In some embodiments, the curing apparatus may include a heater mat, such as heater mat 212, to which the first connector portion may be mounted. In some embodiments, positioning the curing apparatus may involve (or be proceeded by) defining the cure zone by applying a composite material patch and a bond interface to a rework area of the composite material. In some embodiments, step 402 may involve (or be proceeded by) disposing one or more of a perforated release film, a bleeder, an unperforated release film, and a breather proximate the patch opposite the composite material.

Method 400 may further include a step 404 of disposing a vacuum bag film over the curing apparatus opposite the composite material. At step 404, disposing the vacuum bag film over the curing apparatus may not necessarily involve disposing the vacuum bag film vertically above the curing apparatus. For example, the cure zone may be associated with an under-side of a composite material, such as a lower surface of a wing of a commercial airliner, in which case step 404 may involve disposing the vacuum bag film over the curing apparatus opposite the composite material with the vacuum bag film substantially vertically below the curing apparatus.

Method 400 may further include a step 406 of securing the vacuum bag film to the composite material with an adhesive interface to form a vacuum chamber in which the curing apparatus is disposed. For example, the adhesive interface may include double-sided vacuum sealant tape, or any other suitable adhesive, device, mechanism, structure, apparatus, or combination thereof for substantially hermetically sealing a perimeter region of the vacuum bag film to the composite material.

Method 400 may further include a step 408 of substantially hermetically extending the first set of one or more electrical contacts through a hole in the vacuum bag film. For example, the first set of one or more electrical contacts may be included in a electrical coupler, such as coupler 224 of FIGS. 2 and 3. In particular, the electrical coupler may have a hermetically sealed interior through which the first set of one or more electrical contacts protrude out of the vacuum chamber. Further, an exterior of the electrical coupler may be configured to hermetically clamp a perimeter region surrounding the hole, such as region 266 surrounding hole 256 in FIG. 2, thereby substantially preventing atmospheric pressure from traversing the hole (e.g., between the perimeter of the hole and the exterior of the electrical coupler).

In some embodiments, step 408 may be carried out prior to step 406. For example, method 400 may involve hermetically clamping the perimeter region of the hole with the exterior of the electrical coupler prior to securing the vacuum bag film to the composite material. For example, before securing the vacuum bag film to the composite material, a user may use their hand (or other tool) to apply pressure against a base flange of the electrical coupler, which may be mounted to the curing apparatus, to reduce transmission of torque from the electrical coupler to the curing apparatus as the electrical coupler is operated to clamp the perimeter region of the hole.

Method 400 may further include a step of substantially evacuating the vacuum chamber to a substantially evacuated state (e.g., after the hole has been hermetically sealed and vacuum bag film has been secured to the composite material). In the substantially evacuated state, the vacuum bag film may apply a pressing force against the composite material via the curing apparatus (e.g., thereby pressing or compacting the patch and the bond interface toward the rework area).

Method 400 may further include a step of maintaining the vacuum chamber in the substantially evacuated state such that an atmospheric pressure (e.g., 14.7 psi) inside the vacuum chamber increases by no more than 127 mmHg in a five minute interval of time via one or more of the adhesive interface and the hole. In some embodiments, the maintaining step may involve maintaining the vacuum chambing in the substantially evacuated state such that an atmospheric pressure inside the vacuum chamber increases by no more than 51 mmHg in 5 minutes interval. Such maintenance of the vacuum chamber in the substantially evacuated state may ensure that the composite material (e.g., the associated patch and/or bond interface) is suitable compressed during a cure cycle, which may be performed by the one or more electrical components of the curing apparatus in conjunction with circuitry disposed outside of the vacuum chamber, as will be describe below in more detail.

Method 400 may further include a step of electrically interconnecting the first set of one or more electrical contacts with a second set of corresponding one or more electrical contacts. The second set may be included in a second connector portion of the coupler, and may be configured for electrical connection to the circuitry disposed outside of the vacuum chamber.

In some embodiments, the one or more electrical components of the curing apparatus may be configured to operate in conjunction with the circuitry by at least one or more of (a) receiving electrical power from the circuitry via electrical interconnection of the first and second sets for applying thermal energy to the composite material, and (b) transmitting to the circuitry via electrical interconnection of the first and second sets a signal indicative of a measure temperature of the composite material for monitoring application of thermal energy to the composite material. For example, when the first and second sets are electrically interconnected, the circuitry, such as circuitry 116 or 218, may transmit the electrical power to the one or more electrical components of the curing apparatus, such as heating element 128 or heating elements 220. The one or more electrical components of the curing apparatus may use (e.g., convert) the received electrical power to apply thermal energy to the composite material (e.g., the associated bond interface) to cure the composite material (e.g., the associated bond interface) to a substantially cured state. For example, the applied thermal energy may be configured to perform a suitable cure cycle on the composite material (e.g., the associated bond interface), such as the cure cycle depicted in FIG. 5. For example, the one or more electrical components may include a temperature sensing element, such as a thermocouple, infrared camera, or other suitable device, configured to measure the temperature of the composite material, and transmit to the circuitry via the electrical interconnection of the first and second sets the signal indicative of the measured temperature. Based at least in part on the signal, or a plurality of such signals, the circuitry may monitor the application of the thermal energy. For example, the circuitry may be configured to compare the measured temperatures indicated in the signal(s) to the desired (or input) cure cycle. Based on such a comparison, the circuitry may notify a user if the temperature is too high or too low, and/or accordingly adjust a level of electrical power transmitted to the thermal energy applying components of the curing apparatus.

It should be noted that the thermal energy applying components may not directly apply the thermal energy to the composite material. For example, these components may include one or more microwave emitters configured to generate and direct microwaves toward the the composite material, thereby indirectly applying thermal energy via molecular excitation of the associated bond interface.

In some embodiments, step 408 and the step of electrically interconnecting may be performed at least partially concurrently. For example, the second connector portion may mate with the first connector portion to electrically interconnect the second set of corresponding one or more electrical contacts with the first set of one or more electrical contacts. Such mating may also clamp the region of the vacuum bag film surrounding an entire perimeter of the hole between the first and second connector portions thereby hermetically sealing the hole.

However, in other embodiments, step 408 of hermetically extending and the step of electrically interconnecting may not be performed at least partially concurrently. For example, an exterior of the first connector portion may be configured to clamp the region of the vacuum bag film surrounding the hole. For example, the exterior of the first connector portion may include threaded ring configured to clamp the region of the vacuum bag film onto a base flange of the first connector portion to hermetically dispose the first set of one or more electrical contacts outside of the vacuum chamber. In such an embodiment, the second set of one or more electrical contacts may be electrically interconnected with the first set after (or before) the region of the vacuum bag film is clamped by the first connector portion.

In some embodiments, method 400 may further include one or more steps associated with a debagging process. For example, when the bond interface has been cured to the substantially cured state (e.g., reached an end of the cure cycle associated with a particular measured temperature), the circuitry may notify a user. The user may un-mate (e.g., unscrew) the second connector portion from the first connector portion, and may electrically disconnect the first and second sets from one another. The user may unsecure the vacuum bag film from the composite material, and remove the first connector portion from the hole in the vacuum bag film. In some embodiments, the vacuum bag film may be disposable, in which case the vacuum bag film may be discarded (or recycled) after it is unsecured from the composite material. The curing apparatus (and, if used, the perforated release film, the bleeder, the unperforated release film, and the breather) may be removed from the cure zone, and a cure (or bond) of the composite material (e.g., associated with the patch, bond interface, and/or rework area) may be inspected.

Example 4

Figure 5:
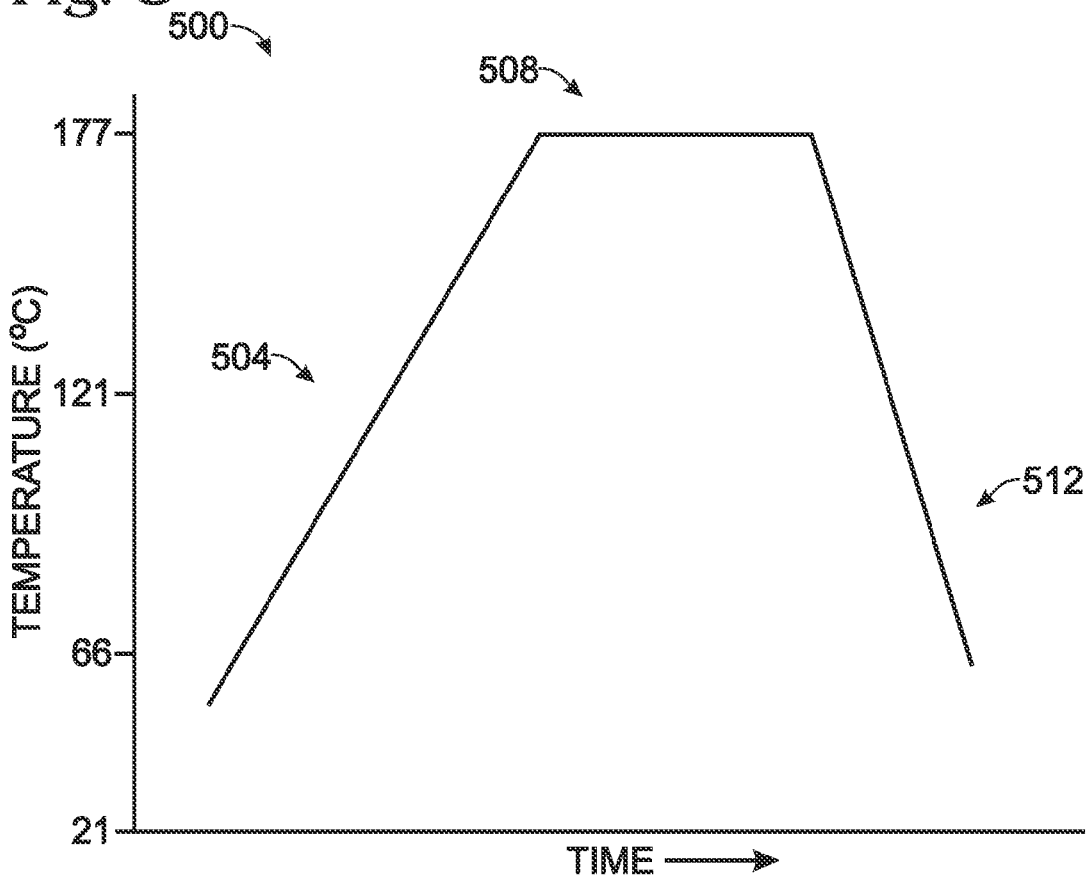
FIG. 5 is a chart illustrating an exemplary cure cycle.

This example describes an illustrative cure cycle (or process) for bonding materials, which may be used in conjunction with any of the apparatuses and/or methods described herein; see FIG. 5.

FIG. 5 shows a chart of an illustrative cure cycle, generally indicated at 500. Cycle 500 may include a heat ramp-up phase 504, a dwell phase 508, and a cool down phase 512.

Prior to cycle 500, materials may be prepared to be bonded together at a bond interface in a bonding or cure zone, which may involve preparing a damaged area and/or applying a patch. A vacuum bag film, or other pressure reduction device, may be applied to the bonding zone to hold the materials together. An apparatus for bonding the materials may be used to define the bonding zone. In some embodiments, the vacuum bag may be placed over the apparatus (e.g., after the apparatus has defined the bonding zone).

Phase 504 may begin at a first predetermined temperature (e.g., of a bond interface defined between the materials), such as at 54 degrees Celsius. In some embodiments, emitted radiation from the apparatus of any of the foregoing examples may be used to heat the bond interface. In some embodiments, the materials (and/or the bond interface) may be initially heated by another source, such as a heat gun, which may be used to heat tack an adhesive layer and/or the materials in place. Phase 504 may involve increasing the temperature of the bond interface at a first predetermined rate, such as at a rate in a range of about 0.5 to 3 degrees Celsius per minute. Phase 504 may continue until the bond interface reaches a second predetermined temperature, which may be a cure (or cured) temperature of the bond interface, such as a temperature of 177 degrees Celsius plus or minus 6 degrees Celsius.

Phase 508 may begin when the bond interface reaches the second predetermined temperature. Phase 508 may involve holding or maintaining the second predetermined temperature for a predetermined duration of time, such as 150 to 210 minutes. Maintaining the second predetermined temperature for the predetermined duration of time may form a suitable bond between the materials (e.g., at the bond interface).

Phase 512 may start when the predetermined duration of time has lapsed. Phase 512 may involve decreasing the temperature of the bond interface at a second predetermined rate, such as at a rate that is less than or equal to 3 degrees Celsius per minute. The second predetermined rate may be a maximum rate at which the temperature of the bond interface can be reduced without reducing a strength of the bond. Phase 512 may continue until the bond interface reaches a third predetermined temperature, such as a temperature at or below 60 degrees Celsius. Once the bond interface has reached the third predetermined temperature, pressure inside the vacuum bag (e.g., pressure inside a vacuum chamber formed at least partially by the vacuum bag) may be released, the vacuum bag and the apparatus may be removed, and the bond between the materials may be inspected.

Example 5

Figure 6:
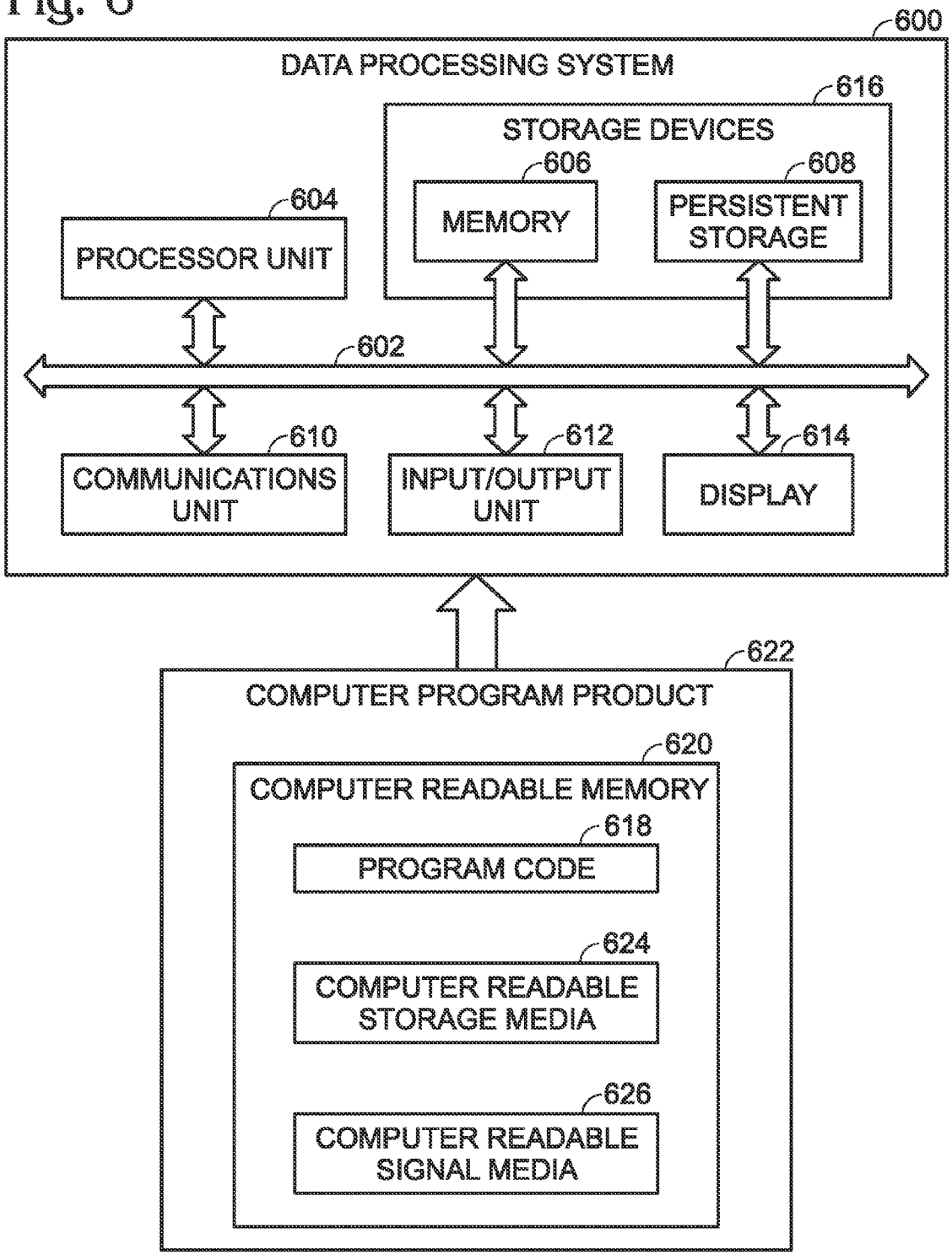
FIG. 6 is a schematic diagram of various components of an illustrative data processing system.

A curing apparatus, such as the one shown and described with reference to FIGS. 2 and 3 (e.g., heater mat 212), may be controlled at least partially (or in some cases, completely) by a data processing system, such as data processing system 600 shown in FIG. 6. For example, data processing system 600 may be an illustrative data processing system, which may be used for implementing one or more of the components and/or functionalities of circuitry 218 of FIGS. 2-3 (and/or circuitry 116 of FIG. 1), or any of the associated components and/or functionalities described herein.

In this illustrative example, data processing system 600 includes communications framework 602. Communications framework 602 provides communications between processor unit 604, memory 606, persistent storage 608, communications unit 610, input/output (I/O) unit 612, and display 614. Memory 606, persistent storage 608, communications unit 610, input/output (I/O) unit 612, and display 614 are examples of resources accessible by processor unit 604 via communications framework 602.

Processor unit 604 serves to run instructions that may be loaded into memory 606. Processor unit 604 may be a number of processors, a multi-processor core, or some other type of processor, depending on the particular implementation. Further, processor unit 604 may be implemented using a number of heterogeneous processor systems in which a main processor is present with secondary processors on a single chip. As another illustrative example, processor unit 604 may be a symmetric multi-processor system containing multiple processors of the same type.

Memory 606 and persistent storage 608 are examples of storage devices 616. A storage device is any piece of hardware that is capable of storing information, such as, for example, without limitation, data, program code in functional form, and other suitable information either on a temporary basis or a permanent basis.

Storage devices 616 also may be referred to as computer readable storage devices in these examples. Memory 606, in these examples, may be, for example, a random access memory or any other suitable volatile or non-volatile storage device. Persistent storage 608 may take various forms, depending on the particular implementation.

For example, persistent storage 608 may contain one or more components or devices. For example, persistent storage 608 may be a hard drive, a flash memory, a rewritable optical disk, a rewritable magnetic tape, or some combination of the above. The media used by persistent storage 608 also may be removable. For example, a removable hard drive may be used for persistent storage 608.

Communications unit 610, in these examples, provides for communications with other data processing systems or devices. In these examples, communications unit 610 is a network interface card. Communications unit 610 may provide communications through the use of either or both physical and wireless communications links.

Input/output (I/O) unit 612 allows for input and output of data with other devices that may be connected to data processing system 600. For example, input/output (I/O) unit 612 may provide a connection for user input through a keyboard, a mouse, and/or some other suitable input device. Further, input/output (I/O) unit 612 may send output to a printer. Display 614 provides a mechanism to display information to a user.

Instructions for the operating system, applications, and/or programs may be located in storage devices 616, which are in communication with processor unit 604 through communications framework 602. In these illustrative examples, the instructions are in a functional form on persistent storage 608. These instructions may be loaded into memory 606 for execution by processor unit 604. The processes of the different embodiments may be performed by processor unit 604 using computer-implemented instructions, which may be located in a memory, such as memory 606.

These instructions are referred to as program instructions, program code, computer usable program code, or computer readable program code that may be read and executed by a processor in processor unit 604. The program code in the different embodiments may be embodied on different physical or computer readable storage media, such as memory 606 or persistent storage 608.

Program code 618 is located in a functional form on computer readable media 620 that is selectively removable and may be loaded onto or transferred to data processing system 600 for execution by processor unit 604. Program code 618 and computer readable media 620 form computer program product 622 in these examples. In one example, computer readable media 620 may be computer readable storage media 624 or computer readable signal media 626.

Computer readable storage media 624 may include, for example, an optical or magnetic disk that is inserted or placed into a drive or other device that is part of persistent storage 608 for transfer onto a storage device, such as a hard drive, that is part of persistent storage 608. Computer readable storage media 624 also may take the form of a persistent storage, such as a hard drive, a thumb drive, or a flash memory, that is connected to data processing system 600. In some instances, computer readable storage media 624 may not be removable from data processing system 600.

In these examples, computer readable storage media 624 is a physical or tangible storage device used to store program code 618 rather than a medium that propagates or transmits program code 618. Computer readable storage media 624 is also referred to as a computer readable tangible storage device or a computer readable physical storage device. In other words, computer readable storage media 624 is a media that can be touched by a person.

Alternatively, program code 618 may be transferred to data processing system 600 using computer readable signal media 626. Computer readable signal media 626 may be, for example, a propagated data signal containing program code 618. For example, computer readable signal media 626 may be an electromagnetic signal, an optical signal, and/or any other suitable type of signal. These signals may be transmitted over communications links, such as wireless communications links, optical fiber cable, coaxial cable, a wire, and/or any other suitable type of communications link. In other words, the communications link and/or the connection may be physical or wireless in the illustrative examples.

In some illustrative embodiments, program code 618 may be downloaded over a network to persistent storage 608 from another device or data processing system through computer readable signal media 626 for use within data processing system 600. For instance, program code stored in a computer readable storage medium in a server data processing system may be downloaded over a network from the server to data processing system 600. The data processing system providing program code 618 may be a server computer, a client computer, or some other device capable of storing and transmitting program code 618.

The different components illustrated for data processing system 600 are not meant to provide architectural limitations to the manner in which different embodiments may be implemented. The different illustrative embodiments may be implemented in a data processing system including components in addition to and/or in place of those illustrated for data processing system 600. Other components shown in FIG. YY can be varied from the illustrative examples shown. The different embodiments may be implemented using any hardware device or system capable of running program code. As one example, data processing system 600 may include organic components integrated with inorganic components and/or may be comprised entirely of organic components excluding a human being. For example, a storage device may be comprised of an organic semiconductor.

In another illustrative example, processor unit 604 may take the form of a hardware unit that has circuits that are manufactured or configured for a particular use. This type of hardware may perform operations without needing program code to be loaded into a memory from a storage device to be configured to perform the operations.

For example, when processor unit 604 takes the form of a hardware unit, processor unit 604 may be a circuit system, an application specific integrated circuit (ASIC), a programmable logic device, or some other suitable type of hardware configured to perform a number of operations. With a programmable logic device, the device is configured to perform the number of operations. The device may be reconfigured at a later time or may be permanently configured to perform the number of operations. Examples of programmable logic devices include, for example, a programmable logic array, a field programmable logic array, a field programmable gate array, and other suitable hardware devices. With this type of implementation, program code 618 may be omitted, because the processes for the different embodiments are implemented in a hardware unit.

In still another illustrative example, processor unit 604 may be implemented using a combination of processors found in computers and hardware units. Processor unit 604 may have a number of hardware units and a number of processors that are configured to run program code 618. With this depicted example, some of the processes may be implemented in the number of hardware units, while other processes may be implemented in the number of processors.

In another example, a bus system may be used to implement communications framework 602 and may be comprised of one or more buses, such as a system bus or an input/output bus. Of course, the bus system may be implemented using any suitable type of architecture that provides for a transfer of data between different components or devices attached to the bus system.

Additionally, communications unit 610 may include a number of devices that transmit data, receive data, or both transmit and receive data. Communications unit 610 may be, for example, a modem or a network adapter, two network adapters, or some combination thereof. Further, a memory may be, for example, memory 606, or a cache, such as that found in an interface and memory controller hub that may be present in communications framework 602.

The flowcharts and block diagrams described herein illustrate the architecture, functionality, and operation of possible implementations of systems, methods, and computer program products according to various illustrative embodiments. In this regard, each block in the flowcharts or block diagrams may represent a module, segment, or portion of code, which comprises one or more executable instructions for implementing the specified logical function or functions. It should also be noted that, in some alternative implementations, the functions noted in a block may occur out of the order noted in the drawings. For example, the functions of two blocks shown in succession may be executed substantially concurrently, or the functions of the blocks may sometimes be executed in the reverse order, depending upon the functionality involved.

Example 6

This section describes additional aspects and features of embodiments, presented without limitation as a series of paragraphs, some or all of which may be alphanumerically designated for clarity and efficiency. Each of these paragraphs can be combined with one or more other paragraphs, and/or with disclosure from elsewhere in this application, including the materials incorporated by reference, in any suitable manner. Some of the paragraphs below expressly refer to and further limit other paragraphs, providing without limitation examples of some of the suitable combinations.

A0. An apparatus comprising: a heater mat including one or more electrical components for applying thermal energy to a composite material inside a vacuum chamber at least partially defined by a flexible wall configured to apply a pressing force against the composite material via the heater mat when the vacuum chamber is substantially evacuated and as the application of the thermal energy at least partially cures the composite material to a substantially cured state; and an electrical coupler including male and female connector portions one of which is connected to the heater mat, the connector portion that is connected to the heater mat including a first set of one or more electrical contacts electrically connected to the one or more electrical components of the heater mat, the other of the connector portions including a second set of one or more electrical contacts configured for electrical connection to circuitry disposed outside of the vacuum chamber, wherein the coupler is configured to extend through and hermetically seal a hole in the flexible wall, and to electrically interconnect the first and second sets of one or more electrical contacts when the male and female connector portions are mated for electrical interconnection of the one or more electrical components of the heater mat disposed inside the vacuum chamber with the circuitry disposed outside of the vacuum chamber.

A1. The apparatus of paragraph A0, wherein the connector portion that is connected to the heater mat is mounted on a major face of the heater mat.

A2. The apparatus of paragraph A1, wherein the connector portion that is mounted on the major face of the heater mat is the male connector portion.

A3. The apparatus of paragraph A2, wherein the male connector portion includes a base flange and a barrel, with the base flange extending generally parallel to the major face, the barrel projecting away from the major face and the base flange, the first set of one or more electrical contacts extending through an interior of the barrel and away from the heater mat, and the base flange radially surrounding a lower portion of the barrel, an upper portion of the barrel being configured to be received through the hole in the flexible wall such that a region of the flexible wall surrounding an entire perimeter of the hole contacts the base flange opposite the major face of the heater mat, the coupler being configured to clamp the region of the flexible wall between the female connector portion and the base flange when the male and female connector portions are mated to form a hermetic seal between the base flange and the region of the flexible wall.

A4. The apparatus of paragraph A3, wherein the interior of the barrel is hermetically sealed with a potting material, and the first set of one or more electrical contacts protrude from the potting material opposite the heater mat.

A5. The apparatus of paragraph A4, wherein the second set of one or more electrical contacts are one or more female electrical contacts configured to receive the first set of one or more electrical contacts protruding from the potting material.

A6. The apparatus of paragraph A4, wherein the potting material has a lower thermal conductivity than a material of the first set of one or more electrical contacts.

A7. The apparatus of paragraph A3, wherein the base flange extends from and is connected to the lower portion of the barrel.

A8. The apparatus of paragraph A0, wherein the one or more electrical components of the heater mat include at least one heating element powered by the circuitry disposed outside the vacuum chamber via electrical interconnection of the first set of one or more electrical contacts with the second set of one or more electrical contacts, the heating element being configured to apply at least a portion of the thermal energy to the composite material.

A9. The apparatus of paragraph A0, wherein the one or more electrical components of the heater mat include a sensor element configured to measure a temperature of the composite material for monitoring application of the thermal energy.

B0. An apparatus comprising: a curing apparatus including one or more electrical components related to curing a composite material inside a vacuum chamber at least partially defined by a flexible wall; and an electrical coupler connected to the curing apparatus, the coupler including a first set of one or more electrical contacts electrically connected to the one or more electrical components of the curing apparatus inside the vacuum chamber, the coupler being configured to hermetically extend through a hole in the flexible wall to dispose the first set of one or more electrical contacts in a space outside of the vacuum chamber for electrical interconnection of the one or more electrical components of the curing apparatus inside the vacuum chamber with circuitry disposed in the space outside of the vacuum chamber.

B1. The apparatus of paragraph B0, wherein the one or more electrical components inside the vacuum chamber include a temperature sensing device configured to measure a temperature of the composite material and transmit a signal to the circuitry via the first set of one or more electrical contacts, the signal being indicative of the measured temperature of the composite material.

B2. The apparatus of paragraph B0, wherein the one or more electrical components inside the vacuum chamber include a heating element of a heater mat configured to be powered by the circuitry disposed in the space outside the vacuum chamber via the first set of one or more electrical contacts for applying thermal energy to the composite material to cure the composite material to a cured state.

B3. The apparatus of paragraph B2, wherein the coupler includes mateable first and second connector portions, the first connector portion being mounted on the heater mat, the first connector portion including the first set of one or more electrical contacts, the second connector portion including a second set of corresponding one or more electrical contacts configured for electrical connection to the circuitry, the coupler being configured to electrically interconnect the first set of one or more electrical contacts with the corresponding one or more electrical contacts of the second set and to hermetically clamp a region of the flexible wall surrounding an entire perimeter of the hole when the first and second connector portions are mated.

B4. The apparatus of paragraph B3, wherein the coupler includes a first washer made of a substantially rigid material, and a second washer made of a substantially resilient material that is less rigid than the rigid material, the first connector portion including a base flange connected to the heater mat, the coupler being configured to hermetically clamp the region of the flexible wall against the base flange by the second connector portion pressing the second washer via the first washer against a first surface of the region of the flexible wall to form a hermetic seal between the base flange and a second surface of the region of the flexible wall that is opposite the first surface of the region of the flexible wall.

C0. A method comprising: positioning a curing apparatus on a cure zone of a composite material, the curing apparatus including one or more electrical components electrically connected to a first set of one or more electrical contacts; disposing a vacuum bag film over the curing apparatus opposite the composite material; securing the vacuum bag film to the composite material with an adhesive interface to form a vacuum chamber in which the curing apparatus is disposed; and hermetically extending the first set of one or more electrical contacts through a hole in the vacuum bag film.

C1. The method of paragraph C0, wherein the hermetically extending step is carried out prior to the securing step.

C2. The method of paragraph C0, further comprising substantially evacuating the vacuum chamber to a substantially evacuated state such that the vacuum bag film applies a pressing force against the composite material via the curing apparatus, and maintaining the vacuum chamber in the substantially evacuated state such that an atmospheric pressure inside the vacuum chamber increases by no more than 127 mmHg in a five minute interval of time via one or more of the adhesive interface and the hole.

C3. The method of paragraph C0, where the first set of one or more electrical contacts are included in a first connector portion of a coupler, the method further comprising electrically interconnecting the first set of one or more electrical contacts with a second set of corresponding one or more electrical contacts included in a second connector portion of the coupler that are configured for electrical connection to circuitry disposed outside of the vacuum chamber, the one or more electrical components of the curing apparatus being configured to operate in conjunction with the circuitry by at least one or more of (a) receiving electrical power from the circuitry via electrical interconnection of the first and second sets for applying thermal energy to the composite material, and (b) transmitting to the circuitry via electrical interconnection of the first and second sets a signal indicative of a measure temperature of the composite material for monitoring application of thermal energy to the composite material.

C4. The method of paragraph C3, wherein the steps of hermetically extending and electrically interconnecting are performed at least partially concurrently by the second connector portion mating with the first connector portion to electrically interconnect the second set of corresponding one or more electrical contacts with the first set of one or more electrical contacts and to clamp a region of the vacuum bag film surrounding an entire perimeter of the hole between the first and second connector portions thereby hermetically sealing the hole.

Advantages, Features, Benefits

The different embodiments described herein provide several advantages over known solutions for electrically interconnecting a curing apparatus inside a vacuum chamber at least partially defined by a flexible wall (e.g., a vacuum bag film made of a suitable flexible material) with circuitry disposed outside of the vacuum chamber. For example, the illustrative embodiments described herein permit a first set of one or more electrical contacts associated with one or more electrical components of the curing apparatus to be hermetically extended through a hole in the flexible wall for electrical interconnection with the circuitry. Such embodiments may reduce leaks in the vacuum chamber, simplify bagging and debagging processes, and increase the durability of associated components, particularly as compared to pre-existing apparatuses and methods. However, not all embodiments described herein provide the same advantages or the same degree of advantage.

CONCLUSION

The disclosure set forth above may encompass multiple distinct embodiments with independent utility. Although each of these embodiments has been disclosed in its preferred form(s), the specific details of which as disclosed and illustrated herein are not to be considered in a limiting sense, because numerous variations are possible. The subject matter of the embodiments includes all novel and nonobvious combinations and subcombinations of the various elements, features, functions, and/or properties disclosed herein. The following claims particularly point out certain combinations and subcombinations regarded as novel and nonobvious. Embodiments of other combinations and subcombinations of features, functions, elements, and/or properties may be claimed in applications claiming priority from this or a related application. Such claims, whether directed to a different embodiment or to the same embodiment, and whether broader, narrower, equal, or different in scope to the original claims, also are regarded as included within the subject matter of the embodiments of the present disclosure.

What is claimed is:

1. An apparatus comprising:

a flexible wall at least partially defining a vacuum chamber adjacent to a composite material;

a heater mat including one or more electrical components inside the vacuum chamber for applying thermal energy to the composite material inside the vacuum chamber, the flexible wall configured to apply a pressing force against the composite material via the heater mat when the vacuum chamber is substantially evacuated and as the application of the thermal energy at least partially cures the composite material to a substantially cured state; and an electrical coupler including male and female connector portions one of which is connected to the heater mat, the connector portion that is connected to the heater mat including a first set of one or more electrical contacts electrically connected to the one or more electrical components of the heater mat, the other of the connector portions including a second set of one or more electrical contacts configured for electrical connection to circuitry disposed outside of the vacuum chamber, wherein the coupler is configured to extend through and form a hermetic seal around a hole in the flexible wall by a connection between the male and female connector portions, and to electrically interconnect the first and second sets of one or more electrical contacts when the male and female connector portions are mated for electrical interconnection of the one or more electrical components of the heater mat disposed inside the vacuum chamber with the circuitry disposed outside of the vacuum chamber.

2. The apparatus of claim 1, wherein the connector portion that is connected to the heater mat is mounted on a major face of the heater mat.

3. The apparatus of claim 2, wherein the connector portion that is mounted on the major face of the heater mat is the male connector portion.

4. The apparatus of claim 3, wherein the male connector portion includes a base flange and a barrel, with the base flange extending generally parallel to the major face, the barrel projecting away from the major face and the base flange, the first set of one or more electrical contacts extending through an interior of the barrel and away from the heater mat, and the base flange radially surrounding a lower portion of the barrel, an upper portion of the barrel being configured to be received through the hole in the flexible wall such that a region of the flexible wall surrounding an entire perimeter of the hole contacts the base flange opposite the major face of the heater mat, the coupler being configured to clamp the region of the flexible wall between the female connector portion and the base flange when the male and female connector portions are mated to form a hermetic seal between the base flange and the region of the flexible wall.

5. The apparatus of claim 4, wherein the interior of the barrel is hermetically sealed with a potting material, and the first set of one or more electrical contacts protrude from the potting material opposite the heater mat.

6. The apparatus of claim 5, wherein the second set of one or more electrical contacts are one or more female electrical contacts configured to receive the first set of one or more electrical contacts protruding from the potting material.

7. The apparatus of claim 5, wherein the potting material has a lower thermal conductivity than a material of the first set of one or more electrical contacts.

8. The apparatus of claim 4, wherein the base flange extends from and is connected to the lower portion of the barrel.

9. The apparatus of claim 1, wherein the one or more electrical components of the heater mat include at least one heating element powered by the circuitry disposed outside the vacuum chamber via electrical interconnection of the first set of one or more electrical contacts with the second set of one or more electrical contacts, the heating element being configured to apply at least a portion of the thermal energy to the composite material.

10. The apparatus of claim 1, wherein the one or more electrical components of the heater mat include a sensor element configured to measure a temperature of the composite material for monitoring application of the thermal energy.

11. An apparatus comprising:

a flexible wall at least partially defining a vacuum chamber adjacent to a composite material;

a curing apparatus including one or more electrical components inside the vacuum chamber, wherein the one or more electrical components include a heating element of a heater mat configured to be powered by circuitry disposed in the space outside the vacuum chamber via a first set of one or more electrical contacts, the heating element configured to apply thermal energy to a composite material inside the vacuum chamber to cure the composite material to a cured state; and an electrical coupler connected to the curing apparatus, the coupler including mateable first and second connector portions, the first connector portion being mounted on the heater mat, the first connector portion including the first set of one or more electrical contacts, the second connector portion including a second set of corresponding one or more electrical contacts configured for electrical connection to the circuitry, the first connector portion being configured to extend through a hole in the flexible wall to dispose the first set of one or more electrical contacts in a space outside of the flexible wall for electrical interconnection with the second connector portion and the second set of corresponding one or more electrical contacts, wherein the electrical coupler is configured to create a hermetic seal around the hole in the flexible wall when the curing apparatus is electrically connected to the circuitry, the hermetic seal formed as a result of the coupler being configured to hermetically clamp a region of the flexible wall surrounding an entire perimeter of the hole when the first and second connector portions are mated.

12. The apparatus of claim 11, wherein the one or more electrical components inside the vacuum chamber include a temperature sensing device configured to measure a temperature of the composite material and transmit a signal to the circuitry via the first set of one or more electrical contacts, the signal being indicative of the measured temperature of the composite material.

13. The apparatus of claim 11, wherein the coupler includes a first washer made of a substantially rigid material, and a second washer made of a substantially resilient material that is less rigid than the rigid material, the first connector portion including a base flange connected to the heater mat, the coupler being configured to hermetically clamp the region of the flexible wall against the base flange by the second connector portion pressing the second washer via the first washer against a first surface of the region of the flexible wall to form a hermetic seal between the base flange and a second surface of the region of the flexible wall that is opposite the first surface of the region of the flexible wall.

14. The apparatus of claim 11, wherein the first connector portion is mounted on a major face of the heater mat.

15. The apparatus of claim 14, wherein the first connector portion is a male connector portion.

16. The apparatus of claim 15, wherein the male connector portion includes a base flange and a barrel, with the base flange extending generally parallel to the major face, the barrel projecting away from the major face and the base flange, the first set of one or more electrical contacts extending through an interior of the barrel and away from the heater mat, and the base flange radially surrounding a lower portion of the barrel, an upper portion of the barrel being configured to be received through the hole in the flexible wall such that a region of the flexible wall surrounding an entire perimeter of the hole contacts the base flange opposite the major face of the heater mat, the coupler being configured to clamp the region of the flexible wall between the female connector portion and the base flange when the male and female connector portions are mated to form a hermetic seal between the base flange and the region of the flexible wall.

17. The apparatus of claim 16, wherein the interior of the barrel is hermetically sealed with a potting material, and the first set of one or more electrical contacts protrude from the potting material opposite the heater mat.

18. The apparatus of claim 17, wherein the second set of one or more electrical contacts are one or more female electrical contacts configured to receive the first set of one or more electrical contacts protruding from the potting material.

19. The apparatus of claim 17, wherein the potting material has a lower thermal conductivity than a material of the first set of one or more electrical contacts.

20. The apparatus of claim 16, wherein the base flange extends from and is connected to the lower portion of the barrel.

* * * * *